US012181177B1

(12) United States Patent
Cipolla, II

(10) Patent No.: US 12,181,177 B1
(45) Date of Patent: Dec. 31, 2024

(54) AIR CONDITIONING SYSTEM AND METHOD COMPRISING AN AUTOMATIC CLEANING OF A CONDENSATE DRAIN PIPE

(71) Applicant: Leonard Salvatore Cipolla, II, Parkland, FL (US)

(72) Inventor: Leonard Salvatore Cipolla, II, Parkland, FL (US)

( * ) Notice: Subject to any disclaimer, the term of this patent is extended or adjusted under 35 U.S.C. 154(b) by 22 days.

(21) Appl. No.: 18/212,842

(22) Filed: Jun. 22, 2023

Related U.S. Application Data

(60) Provisional application No. 63/354,414, filed on Jun. 22, 2022.

(51) Int. Cl.
*F24F 13/22* (2006.01)
*F24F 11/32* (2018.01)
*F24F 140/30* (2018.01)

(52) U.S. Cl.
CPC ..... *F24F 13/222* (2013.01); *F24F 11/32* (2018.01); *F24F 2013/227* (2013.01); *F24F 2140/30* (2018.01); *F24F 2221/225* (2013.01)

(58) Field of Classification Search
CPC .... F24F 13/222; F24F 11/32; F24F 2013/227; F24F 2140/30; F24F 2221/25
See application file for complete search history.

(56) References Cited

U.S. PATENT DOCUMENTS 4,998,412 A * 3/1991 Bell ..... F24F 13/22 138/92
6,442,956 B1 * 9/2002 Herren ..... F24F 13/222 62/272
7,857,004 B2 * 12/2010 Pearson ..... F24F 13/222 137/240
9,975,152 B1 * 5/2018 McClarren ..... F24F 13/222
10,246,358 B1 * 4/2019 Lohse ..... C02F 1/686
11,333,394 B2 * 5/2022 Bush ..... B08B 3/02
11,333,423 B2 * 5/2022 Skomsøy ..... F28F 17/005
11,719,464 B1 * 8/2023 McDonnell ..... F24F 13/222 137/238
12,030,097 B2 * 7/2024 McDonnell ..... B08B 9/0325
2011/0308557 A1 * 12/2011 Kaiser ..... B08B 9/027 134/198
2019/0337027 A1 * 11/2019 Raynes, II ..... B08B 9/0321
2021/0131083 A1 * 5/2021 Shelton ..... E03C 1/306

* cited by examiner

*Primary Examiner* — Umashankar Venkatesan

(74) *Attorney, Agent, or Firm* — John Rizvi; John Rizvi, P.A.—The Patent Professor®

(57) ABSTRACT

An air conditioning system, capable of automatically unclogging an air handler condensate drain tube, includes a primary fluid control valve to allow or prevent draining from the air handler through the condensate drain tube, and at least one secondary fluid control valve for allowing or preventing fluid flow from a cleaning fluid source to the condensate drain tube. First and second condensate sensors may sense condensate accumulation in two areas arranged one higher than the other. A controller may sense an activation of the first and second condensate sensors, and may close the primary fluid control valve preventing fluid flow from the condensate drain tube into the air handler, and open the secondary fluid control valve or valves enabling fluid flow from the respective cleaning fluid source to the condensate drain tube, to break and drain out a clog formed in the condensate drain tube.

20 Claims, 5 Drawing Sheets

AIR CONDITIONING SYSTEM AND METHOD COMPRISING AN AUTOMATIC CLEANING OF A CONDENSATE DRAIN PIPE

CROSS-REFERENCE TO RELATED APPLICATION

This application claims the benefit of U.S. Provisional Patent Application No. 63/354,414, filed on Jun. 22, 2022, which is incorporated by reference herein in its entirety.

FIELD OF THE INVENTION

The present invention relates generally to air conditioning systems and methods, and more particularly, to an air conditioning system and method capable of automatically cleaning a clogged condensate drain tube without the need for human intervention.

BACKGROUND OF THE INVENTION

Air conditioning systems are configured to cool air inside a space such as, but not limited to, a home or business, by transferring heat from the air inside the space to outside the space. For this purpose, air conditioning systems typically include a compressor, a condenser, and an evaporator, which may be integrated into a single apparatus or divided into separate equipment. For example, many home and business air conditioning systems are comprised of an inside unit or air handler, which is located inside the space to be cooled and contains the evaporator and associated parts, and an outside unit, which is located outside the space to be cooled and contains the compressor and condenser. In a common home or business installation, for instance, the air handler may be located inside a closet and the outside unit may be located at a back or rooftop of the building. Furthermore, conventional air conditioning systems typically include a thermostat, which activates operation of the system when the surrounding temperature rises above or reaches a preset temperature threshold.

Operation of the air conditioning system is based on circulation of a coolant through the evaporator, compressor, and condenser, and changing the state of the coolant from liquid to gas and vice versa, wherein, during the change from liquid to gas, heat is absorbed from surrounding air thereby cooling the surrounding air. More specifically, at the evaporator, the coolant is received in a relatively high-pressure, cool liquid state and is evaporated resulting in low-pressure cool gas, which is circulated back to the compressor and condenser to once more convert the coolant into the relatively high-pressure, cool liquid state to be circulated back to the evaporator. In the air handler, a blower suctions relatively warm air from the home or business space to be cooled and into the air handler through an air inlet and filter, circulates the air through the evaporator, and expels the air from the air handler back into the space to be cooled. As the relatively warm air is circulated through the evaporator, heat from the air is used to evaporate the coolant, as a result of which the air is cooled, and chilled air is thus expelled from the air handler into the home or business space. As the air is cooled, condensate is formed and air humidity is reduced, causing the expelled, chilled air to also be less humid than the air suctioned into the air handler.

In many conventional installations, the air handler is provided with a condensate drain pan and drain line for collecting condensate (mainly liquid water) formed in the evaporator and subsequently draining the condensate to outside the building or to another applicable destination. In practice, however, a sludge tends to form in condensate drain tubes over time, which if left unattended will cause the lines to become clogged and condensate to overflow out of the air handler. To reduce damages caused by this accidental overflow, an auxiliary drain pan is often installed below the air handler. However, the drain pan may only collect a limited amount of condensate water in the event of clogging of the condensate drain tube. If the clogging continues once the drain pan is filled with condensate water, water will overflow out of the drain pan and likely damage surrounding flooring, furniture, or the like, leading to significant economic loss and stress to the home or business owner or occupant.

Accordingly, there is an established need for a solution to at least one of the aforementioned problems. For example, there remains a need for an air conditioning system in which clogging of a condensate drain tube may be promptly and conveniently resolved, to increase user satisfaction and minimize the changes of damages to surrounding property.

SUMMARY OF THE INVENTION

The present invention is directed to an air conditioning system capable of automatically unclogging an air handler condensate drain tube without the need for human intervention. The air conditioning system may include a primary fluid control valve to allow or prevent draining from the air handler through the condensate drain tube. The air conditioning system may further include at least one secondary fluid control valve for allowing or preventing fluid flow from a cleaning fluid source such as, but not limited to, compressed air, a cleaning solution, or an existing home or business hot water line, to the condensate drain tube. The system may further include first and second condensate sensors configured to sense condensate accumulation in two areas arranged one higher than the other. A controller may sense an activation of the first and second condensate sensors, and may responsively close the primary fluid control valve preventing fluid flow from the condensate drain tube into the air handler, and open the secondary fluid control valve or valves enabling fluid flow from the respective cleaning fluid source to the condensate drain tube, to break and drain out a clog formed in the condensate drain tube.

In a first implementation of the invention, an air conditioning system may include a primary fluid control valve and at least one secondary fluid control valve. The primary fluid control valve may be configured to selectively allow or prevent fluid communication between an air handler and a condensate drain tube of the air conditioning system. The at least one secondary fluid control valve may be arranged in fluid communication with the condensate drain tube downstream of the primary fluid control valve. Each secondary fluid control valve may be positioned between a respective fluid source and a point of connection to the condensate drain tube located downstream of the primary fluid control valve. The air conditioning system may further include a first condensate sensor configured to sense condensate in a first area, and a second condensate sensor configured to sense condensate in a second area arranged outside the condensate drain tube and vertically lower than the first area. A controller may be operatively connectable to the primary fluid valve, at least one secondary fluid valve, first condensate sensor and second condensate sensor. The controller may include a processor and a memory. The memory may store processor-readable instructions configured to cause the processor to execute the operations of: detecting an activation of the first condensate sensor, detecting an activation of the second condensate sensor, switching the primary fluid control valve to a closed position preventing fluid flow from the air handler through the condensate drain tube, and switching the at least one secondary fluid control valve to an open position enabling fluid flow from the respective fluid source to the condensate drain tube, causing the fluid flow to break and at least partially remove a clog from the condensate drain tube.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward an air conditioning system and method capable of automatically cleaning a clogged condensate drain tube without the need for human intervention. Shown throughout the figures are several embodiments of the air conditioning system, and air conditioning methods or method of operation of an air conditioning system.

Figure 1:
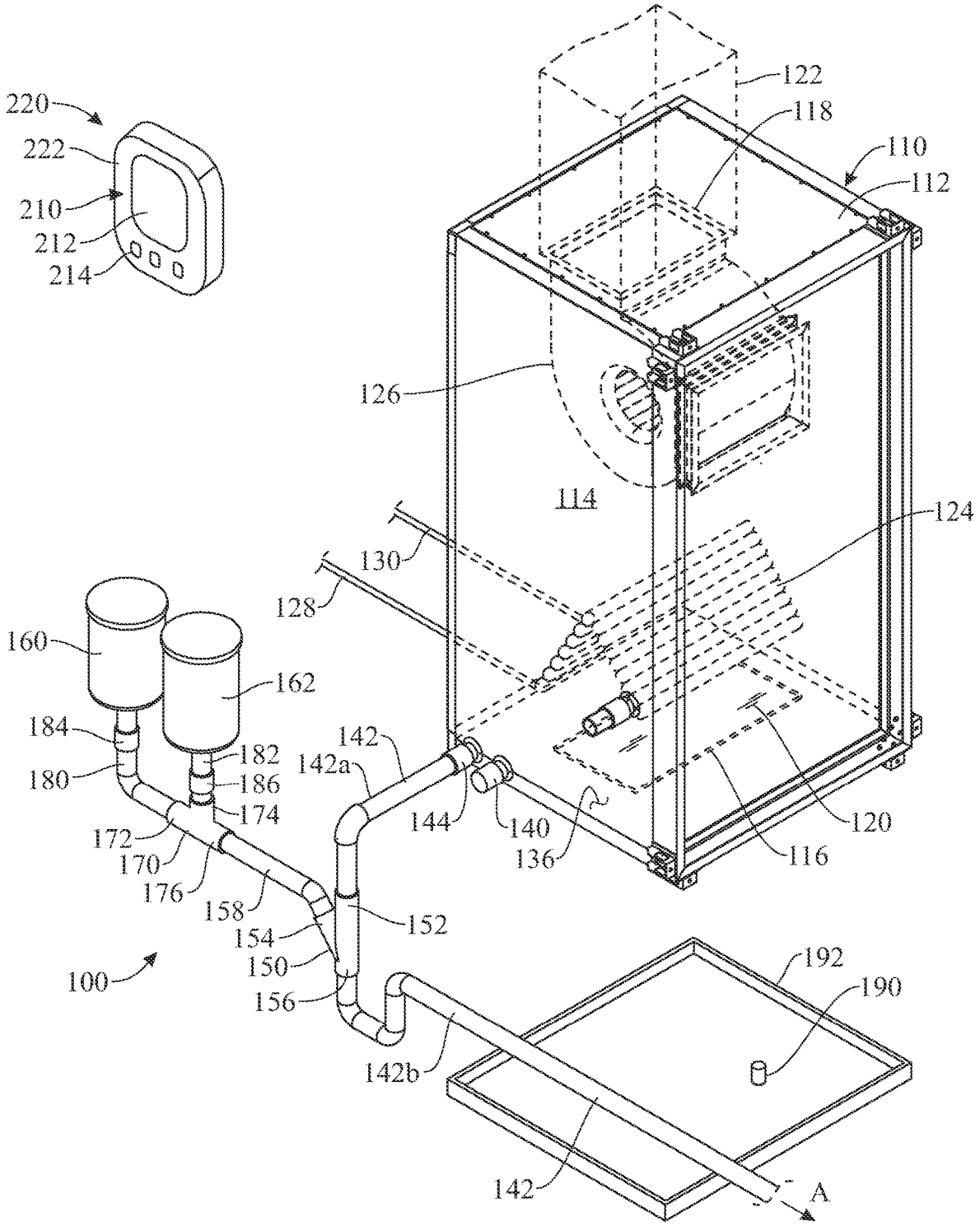
FIG. 1 presents a schematic, isometric view of an air conditioning system in accordance with an illustrative embodiment of the present invention.
Figure 2:
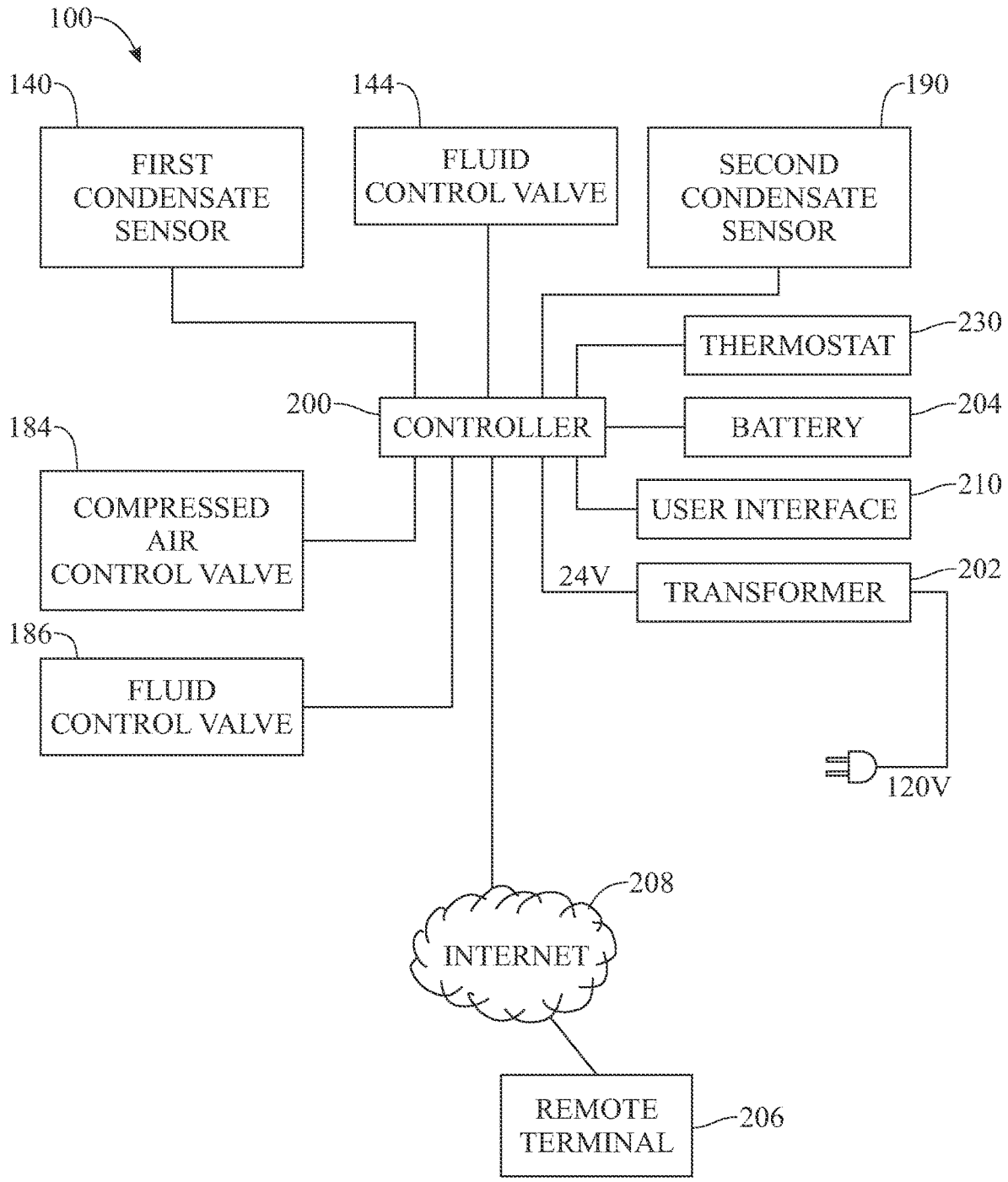
FIG. 2 presents a block diagram of the air conditioning system of FIG. 1.

The illustrations of FIGS. 1 and 2 show an air conditioning system 100 in accordance with a first embodiment of the invention. With reference initially to FIG. 1, the air conditioning system 100 includes an air handler 110 having a housing 112 defining an interior space 114. An air inlet 116 and an air outlet 118 are formed in the housing 112 in fluid communication with the interior space 114. The air inlet 116 may be in direct communication with a living space and configured to intake relatively warm air from the living space. An air filter 120 may be provided at the air inlet 116 for filtering the outside air prior to flowing into the interior space 114. In turn, an air duct 122 may extend from the air outlet 118, such as to direct air being forced out of the air handler 110 into other areas of the living space and/or other areas of the home, business, or other facility at which the air conditioning system 100 is installed. It should be noted that, while a specific air handler 110 is shown and will be further described herein, alternative air handlers 110 and/or air conditioning units may be included without departing from the scope of the present invention.

With continued reference to FIG. 1, the air handler 110 may further include an evaporator 124 and a blower 126. A coolant intake line 128 is configured to feed a coolant from an external compressor and condenser unit to the evaporator 124, and a coolant outlet line 130 allows to circulate the coolant back to the external compressor and condenser unit, as known for instance in the art. The blower 126 is configured to suction air through the air filter 120 and air inlet 116, and subsequently into and through the interior space 114 of the housing 112, through the air outlet 118 and into the air duct 122. At a bottom end of the housing 112, an internal, primary drain pan 136 may extend generally vertically lower than or below the evaporator 124 and around the air inlet 116, to capture condensate generated at the evaporator 124 and inside the housing 112 during the air cooling process.

A first condensate sensor 140 and condensate drain tube 142 may extend from or may be otherwise connected to or comprised in the housing 112, and may be arranged in fluid communication with an interior space of the primary drain pan 136 at which condensate will accumulate after falling along the interior space 114 due to gravity. The first condensate sensor 140 may be configured to detect condensate accumulation at the primary drain pan 136; for instance, in one embodiment, the first condensate sensor 140 may include a float switch. The first condensate sensor 140 is configured to sense that the condensate accumulated in the primary drain pan 136 has exceeded or reached a certain predetermined threshold, for purposes that will be hereinafter described. A fluid control valve 144, such as, but not limited to a normally-open solenoid valve or other electrically-operated valve, is provided at the condensate drain tube 142 for selectively opening and closing fluid flow through the condensate drain tube 142, for purposes that will be hereinafter described. In a non-limiting example, the solenoid or otherwise electrically-operated, fluid control valve 144 may operate at 24 V.

With continued reference to FIG. 1, the condensate drain tube 142 may extend away from the housing in order to carry condensate to outside the building or to another applicable destination, as indicated schematically by arrow A. Downstream of the fluid control valve 144, the condensate drain tube 142 may be provided with a tubing fitting 150. In some embodiments, such as the present embodiment, the tubing fitting 150 may include first, second and third connectors 152, 154 and 156, respectively. The first and third connectors 152 and 156 may be connected to and in fluid communication with first and second segments 142*a* and 142*b* of the condensate drain tube 142 arranged upstream and downstream of the tubing fitting 150, respectively. In turn, the second connector 154 may be connected to and in fluid communication with an auxiliary tubing 158. In some embodiments, such as the present embodiment, the tubing fitting 150 may be a Y-shaped fitting, such that the first and second connectors 152 and 154 are oriented in substantial opposition to the third connector 156 to promote downstream fluid flow from the first and second connectors 152 and 154 towards the third connector 156.

The air conditioning system 100 may further include a compressed air container 160 and a liquid container 162. The compressed air container 160 may contain compressed air or another compressed gas, hereinafter referred to generically as compressed air. The liquid container 162 may contain a cleaning solution. The compressed air container 160 and liquid container 162 may be provided in selective fluid communication with the condensate drain tube 142, such as via the auxiliary tubing 158 and tubing fitting 150. For instance, in one embodiment, a tubing fitting 170 may be connected to the auxiliary tubing 158, and may provide fluid communication from the compressed air container 160 and the liquid container 162 to the auxiliary tubing 158. In some embodiments, such as the present embodiment, the tubing fitting 170 may include first, second and third connectors 172, 174 and 176, respectively. A compressed air container tubing 180 may provide fluid communication between the first connector 172 and the compressed air container 160. A liquid container tubing 182 may, in turn, provide fluid communication between the second connector 174 and the liquid container 162. The third connector 176 may be connected to and in fluid communication with the auxiliary tubing 158, to direct respective fluids from the first and second connectors 152 and 154 to the auxiliary tubing 158 and towards the second connector 154 of the tubing fitting 150. In some embodiments, the tubing fitting 170 may be a Y-shaped fitting, such that the first and second connectors 172 and 174 are oriented in substantial opposition to the third connector 176 to promote downstream fluid flow from the first and second connectors 172 and 174 towards the third connector 176.

The air conditioning system 100 further includes a compressed air control valve 184 and a fluid control valve 186, which, in some embodiments, may include or consist in a respective normally-closed solenoid valve or other electrically-operated valve. The compressed air control valve 184 may be provided at the compressed air container 160 or the compressed air container tubing 180 for selectively allowing or preventing compressed air flow from the compressed air container 160 to the first connector 172 of the tubing fitting 170. The fluid control valve 186 may be provided at the liquid container 162 or the liquid container tubing 182 for selectively allowing or preventing a flow of cleaning solution from the liquid container 162 to the second connector 174 of the tubing fitting 170. In a non-limiting example, the solenoid or otherwise electrically-operated, compressed air control valve 184 and fluid control valve 186 may operate at 24 V.

With continued reference to FIG. 1, the air conditioning system 100 may further include a second condensate sensor 190. In one non-limiting example, the second condensate sensor 190 may include a float switch. The second condensate sensor 190 may be arranged in spaced-apart relationship with the first condensate sensor 140 and configured to detect condensate accumulation at a location different to the primary drain pan 136. For instance, in some embodiments, such as the present embodiment, the second condensate sensor 190 may be configured to detect condensate accumulation within a secondary drain pan 192 located below the air handler 110. The secondary drain pan 192 may be configured to collect condensate dripping or overflowing from the air handler 110, which may occur, for instance, in the event of clogging of the condensate drain tube 142.

As shown in FIGS. 1 and 2, a controller 200 may operatively interface with components of the air conditioning system 100 such as, but not limited to, the first condensate sensor 140, second condensate sensor 190, fluid control valve 144, compressed air control valve 184, and fluid control valve 186. The controller 200 may include at least one processor and at least one data storage memory, hereinafter referred to generically as processor and memory. The memory may store processor-readable instructions readable by the processor and configured to cause the processor to execute operations such as those described hereinafter. The controller 200 may further include at least one communications module, configured to allow for local or remote communication between the controller 200 and an external device such as, but not limited to, an external and/or pluggable storage memory, phone, tablet, computer, computer network, server, etc. Non-limiting examples of a communications module include wired or wireless communications such as, but not limited to, USB, Ethernet, 802.11 (Wi-Fi), Bluetooth®, cellular communications (e.g., GSM, CDMA, etc.), etc. In the non-limiting example shown in FIG. 2, the communications module of the controller 200 is configured to communicate with a remote terminal 206, such as, but not limited to, a remote computer, server, control station, first responder control system or center, etc., via a computer network 208 such as, but not limited to, the Internet.

In some embodiments, the communications module may also provide an operative interface between the controller 200 and any one of the first condensate sensor 140, second condensate sensor 190, fluid control valve 144, compressed air control valve 184, and fluid control valve 186. In other embodiments, the communications module may operatively interface with any one of the first condensate sensor 140, second condensate sensor 190, fluid control valve 144, compressed air control valve 184, and fluid control valve 186 by a wired connection (e.g., a pair of electrical wires) or a wireless connection (e.g., an RF or other electromagnetic connection).

As further shown in FIG. 2, electrical power may be provided to the controller 200, for instance, by a transformer 202, configured to convert electrical power from an external power source (e.g., 120 VAC received from an electrical power grid or external generator) into an operative power (e.g., 24 VDC) configured to drive the controller 200 and connected valves and/or sensors. Alternatively or additionally, at least one rechargeable or replaceable battery 204 may operatively interface with the controller 200, to provide electrical power to the controller 200 and connected valves and/or sensors. In some embodiments, the at least one battery 204 may be recharged by electrical power received from the external power source, such as via the transformer 202. In some embodiments, electrical power required by any one of the first condensate sensor 140, second condensate sensor 190, fluid control valve 144, compressed air control valve 184, and fluid control valve 186 may be supplied from the controller 200.

In some embodiments, the air conditioning system 100 may include a user interface 210. The user interface 210 may be provided in an electronic device 220 comprising a housing 222. The user interface 210 may include, for instance and without limitation, one or more of a screen 212, a button or other user-operable controls 214, etc. In some embodiments, the screen 212 may be tactile and provide virtual on-screen user operable controls, additionally or alternatively to the one or more buttons or user-operable controls 214. In non-limiting examples of the invention, the electronic device 220 may include a phone, tablet, wall-mounted device, or other electronic device running a software program configured to operate the air conditioning system 100 as will be described hereinafter. In some embodiments, at least one of the controller 200, transformer 202, and battery 204 may be comprised in or form part of the electronic device 220. In preferred embodiments, the controller 200 and power-providing elements (transformer 202 and/or battery 204) are comprised in or form part of the electronic device 220, such that the air conditioning system 100 is rapidly and easily retrofittable, for instance, to an existing air conditioning installation comprising an air handler, a condensate drain tube, and a secondary drain pan, by simply installing and interconnecting the electronic device 220 and the valves and sensors described heretofore, and powering the electronic device 220, valves and sensors.

The air conditioning system 100 may further include a thermostat 230, configured to sense a temperature of a surrounding environment and change state (e.g., activate a thermostat switch) in the event that the sensed temperature rises above or reaches a preset temperature threshold. In some embodiments, the thermostat 230 may be comprised in the electronic device 220; in such embodiments, the predetermined temperature threshold of the thermostat 230 may be adjustable via the user interface 210. In other embodiments, the thermostat 230 may be external to the electronic device 220; for instance, the thermostat 230 may be an existing thermostat of an air conditioning installation being retrofitted with the present invention.

An illustrative method of operation of the air conditioning system 100 will now be described with reference to FIGS. 1 and 2. Initially, a surrounding or room temperature may be lower than a predetermined temperature threshold of the thermostat 230, and the thermostat 230, and thus the evaporator 124, blower 126, and outside compressor and condenser may remain deactivated. As the room temperature rises, the thermostat 230 may sense a temperature increase above the predetermined temperature threshold, and may responsively activate the evaporator 124, blower 126, and outside compressor and condenser. As a result of this activation, a relatively high-pressure, cool liquid coolant may be fed into the evaporator 124 via the coolant intake line 128. Simultaneously, the blower 126 may suction surrounding air into the interior space 114 of the housing 112 through the air inlet 116 and air filter 120, and further through the evaporator 124 and out of the housing 112 through the air outlet 118. As this relatively warm air passes through the evaporator 124, heat from the passing air is used to evaporate the coolant, causing the passing air temperature to decrease. As the air is cooled, condensate is formed in the area of the evaporator 124, thereby reducing air humidity. Thus, a relatively cooler and dryer air is provided at the air outlet 118 and into the air duct 122, to be fed back into the home or business space. After the evaporation process, the coolant, now in a cool, low-pressure gaseous state, is circulated back via the coolant outlet line 130 to the compressor and condenser to once more convert the coolant into the relatively high-pressure, cool liquid state to be circulated back to the evaporator 124. This air conditioning process continues until the thermostat 230 senses a room temperature drop below the predetermined temperature threshold, at which point the thermostat 230 deactivates the evaporator 124, blower 126, and outside compressor and condenser. During operation of the air conditioning unit, condensate produced by cooling of the air circulating through the evaporator 124 is collected in the primary drain pan 136 and drained through the condensate drain tube 142 to outside the building or to another applicable destination. In turn, on the controller 200 side, the controller 200 monitors the first and second condensate sensors 140 and 190 during normal operation of the air conditioning system 100; during such normal operation, said first and second condensate sensors 140 and 190 may remain in a deactivated state, indicating that condensate is being successfully drained through the condensate drained tube 142. In this initial, normally-working state, fluid control valve 144 is open and permits adequate draining through the condensate drain tube 142; in turn, the compressed air control valve 184 and the fluid control valve 186 are closed and block any fluid communication between the respective compressed air container 160 and liquid container 162 and the condensate drain tube 142.

As happens often, continued operation of the air conditioning system 100 may cause sludge to build up in the condensate drain tube 142 to such an extent that the condensate drain tube 142 becomes clogged. In the event of such clogging, condensate is no longer drained from the air handler 110 and therefore begins to accumulate inside the primary drain pan 136 of the air handler 110. Continued clogging eventually causes the first condensate sensor 140 to sense a presence of condensate within the primary drain pan 136 beyond a predetermined threshold (e.g., a float switch sensing a condensate reaching a predetermined level) and responsively activate, causing an activation signal to be transmitted or relayed to the controller 200. In some embodiments, responsively to activation of the first condensate sensor 140, the air conditioning system 100 may be shut off by the controller 200; in other embodiments, such as in an air conditioning system which has been retrofitted with the invention, a separate thermostat device comprised in the air conditioning system may shut off the air conditioning system upon activation of the first condensate sensor 140 or upon activation of a separate float switch or other sensor configured to similarly monitor the primary drain pan 136.

Under these circumstances, an overflow of condensate from the primary drain pan 136 may have fallen into the secondary drain pan 192. Accumulation of condensate within the secondary drain pan 192 is then detected by the second condensate sensor 190, causing the second condensate sensor 190 to activate. The activation signals from the first and second condensate sensors 140 and 190 may be received generally consecutively by the controller 200.

On the controller 200 side, from an initial situation in which the air conditioning system 100 is operating normally and the first and second condensate sensors 140 and 190 are deactivated, the controller 200 may detect the activation signal corresponding to the activation of the first condensate sensor 140. At this point, the controller 200 may continue to monitor the second condensate sensor 190; if the controller 200 detects the second condensate sensor 190 activation signal within a predetermined time from the activation signal corresponding to the first condensate sensor 140, the controller 200 determines the condensate drain tube 142 is clogged, and responsively sends a command signal to the fluid control valve 144 to close the fluid control valve 144 and thereby cut off fluid communication between the primary drain pan 136 and the condensate drain tube 142. In some embodiments, the predetermined amount of time may be set to, for instance and without limitation, up to 5 seconds. It should be noted that, in different embodiments, this predetermined amount of time may be saved in the memory of the controller 200 and may be optionally adjustable during manufacture of the controller 200, during installation of the controller 200, and/or via the user interface 210.

Once the fluid control valve 144 is closed, the controller 200 operates the compressed air control valve 184 and fluid control valve 186 to execute a cleaning cycle in accordance with a predetermined cleaning cycle mode or profile, which may be stored in the memory of the controller 200. During the cleaning cycle, compressed air and a cleaning solution are provided from the compressed air container 160 and fluid container 162 to the condensate drain tube 142 via the compressed air control valve 184 and fluid control valve 186, respectively. In some embodiments, the predetermined cleaning cycle may be selected from a plurality of available cleaning cycle modes via the user interface 210. Alternatively or additionally, one or more predetermined cleaning cycle modes may be configured, and preferably stored in the memory, by operating the user interface 210. Alternatively or additionally, one or more predetermined cleaning cycle modes may be pre-configured during manufacture or on-site installation of the controller 200.

In one non-limiting example of a cleaning cycle or mode of operation of the compressed air control valve 184 and fluid control valve 186, the controller 200 first opens the compressed air control valve 184 in discrete, spaced-apart intervals, causing bursts of compressed air to be injected into the condensate drain tube 142 via the compressed air container tubing 180 the tubing fitting 170, the auxiliary tubing 158, and the tubing fitting 150. The bursts of compressed air may initially break apart the sludge or other clogging mass, and/or separate the clogging mass from internal walls of the condensate drain tube 142. Next, the controller 200 may close the compressed air control valve 184, and subsequently open the fluid control valve 186 to cause cleaning solution to flow from the liquid container 162 to the condensate drain tube 142 via the liquid container tubing 182, the tubing fitting 170, the auxiliary tubing 158, and the tubing fitting 150. The cleaning solution may contribute to further breaking up the clogging mass and washing the internal walls of the condensate drain tube 142. Resulting semisolids within the condensate drain tube 142 may then flow downstream along the condensate drain tube 142, while the fluid control valve 144 prevents backflow into the air handler 110. After a predetermined amount of time, the controller 200 may close the fluid control valve 186. Following the fluid control valve 186 closure, the controller 200 may repeat the process above by once more sending bursts of compressed air followed by cleaning solution. Alternatively or additionally, the controller 200 may open the air control valve 184 and fluid control valve 186 simultaneously and allow a combination of compressed air and cleaning solution to be injected into the condensate drain valve 142. After a predetermined amount of time, such as, but not limited to, about 30 to 60 seconds, the controller 200 may end the cleaning cycle by closing the air control valve 184 and fluid control valve 186, and may then reopen the fluid control valve 144. In some embodiments, the controller 200 may wait a predetermined amount of time (e.g., 5-10 seconds) between closing the valves 184 and 186 and opening the fluid control valve 144, to allow for the cleaning solution to further drain downstream through the condensate drain tube 142 before opening the fluid control valve 144. Operation of the air conditioning system 100 may then be restarted by the controller 200 or other applicable control system (e.g., a separate thermostat).

It should be noted that alternative cleaning cycles, or modes of operation of the compressed air control valve 184 and fluid control valve 186, are contemplated without departing from the scope of the present disclosure. For example, the controller 200 may alternately open each one of the compressed air control valve 184 and fluid control valve 186 to alternately inject compressed air and cleaning solution into the condensate drain tube 142. Alternatively or additionally, the controller 200 may simultaneously open the compressed air control valve 184 and fluid control valve 186 to jointly inject compressed air and cleaning solution into the condensate drain tube 142. At the end of the cleaning cycle, the controller 200 may close the air control valve 184 and fluid control valve 186 and reopen the fluid control valve 144. Operation of the air conditioning system 100 may then be restarted by the controller 200 or other applicable control system (e.g., a separate thermostat).

Figure 3:
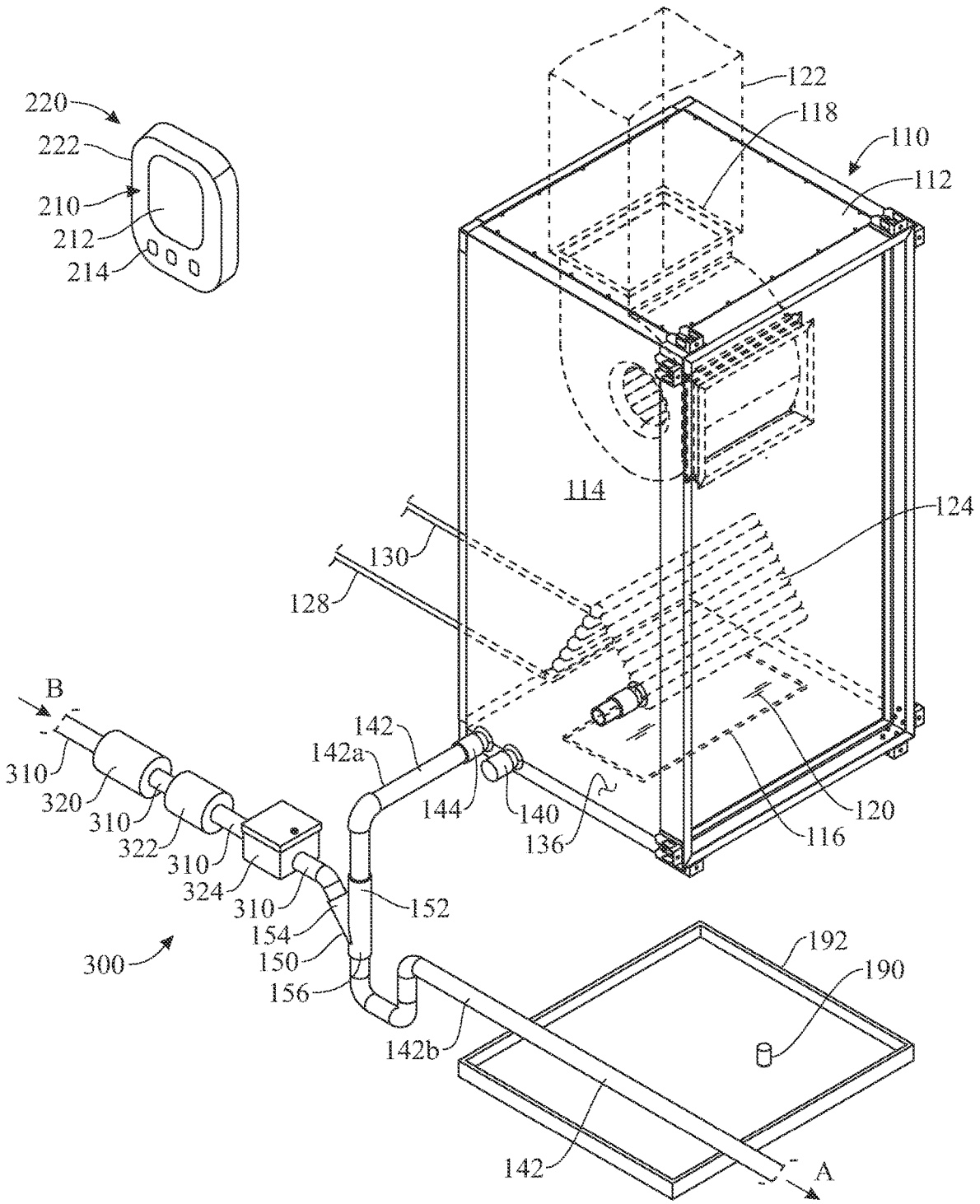
FIG. 3 presents a schematic, isometric view of an air conditioning system in accordance with another illustrative embodiment of the present invention.
Figure 4:
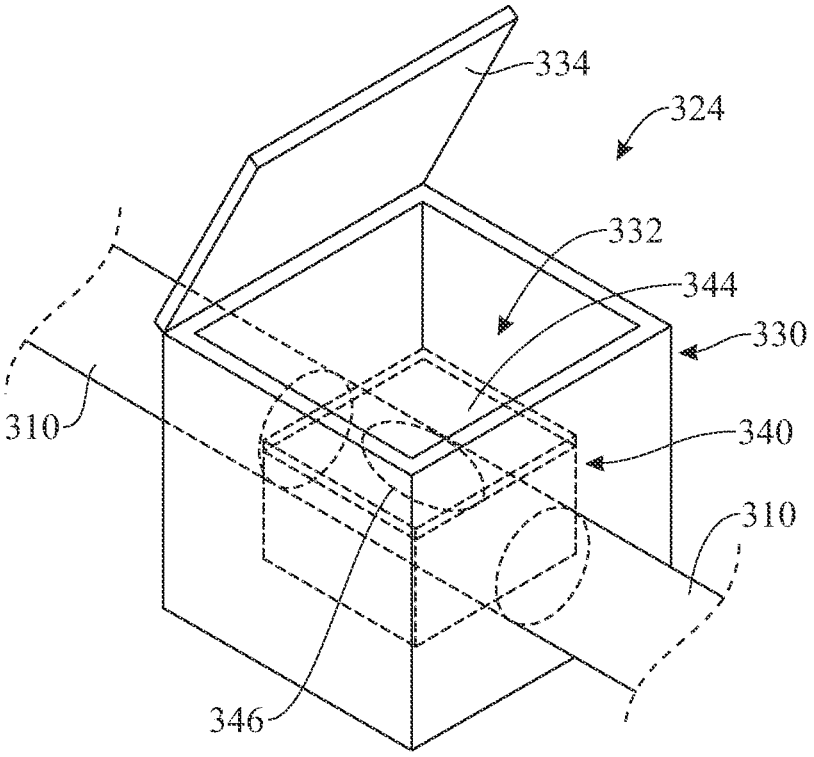
FIG. 4 presents a schematic, top isometric view of a tablet holder assembly of the air conditioning system of FIG. 3, in accordance with one embodiment of the invention, the tablet holder assembly shown connected to the auxiliary tubing.
Figure 5:
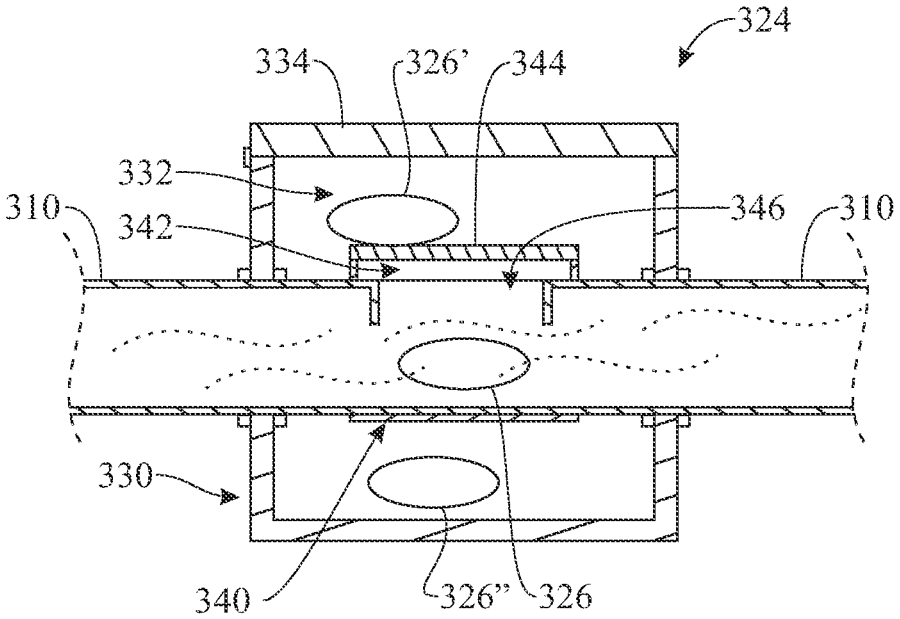
FIG. 5 presents a cross-sectional side elevation view of the tablet holder assembly and tubing of FIG. 4, further showing a sanitation tablet placed inside the auxiliary tubing.
Figure 6:
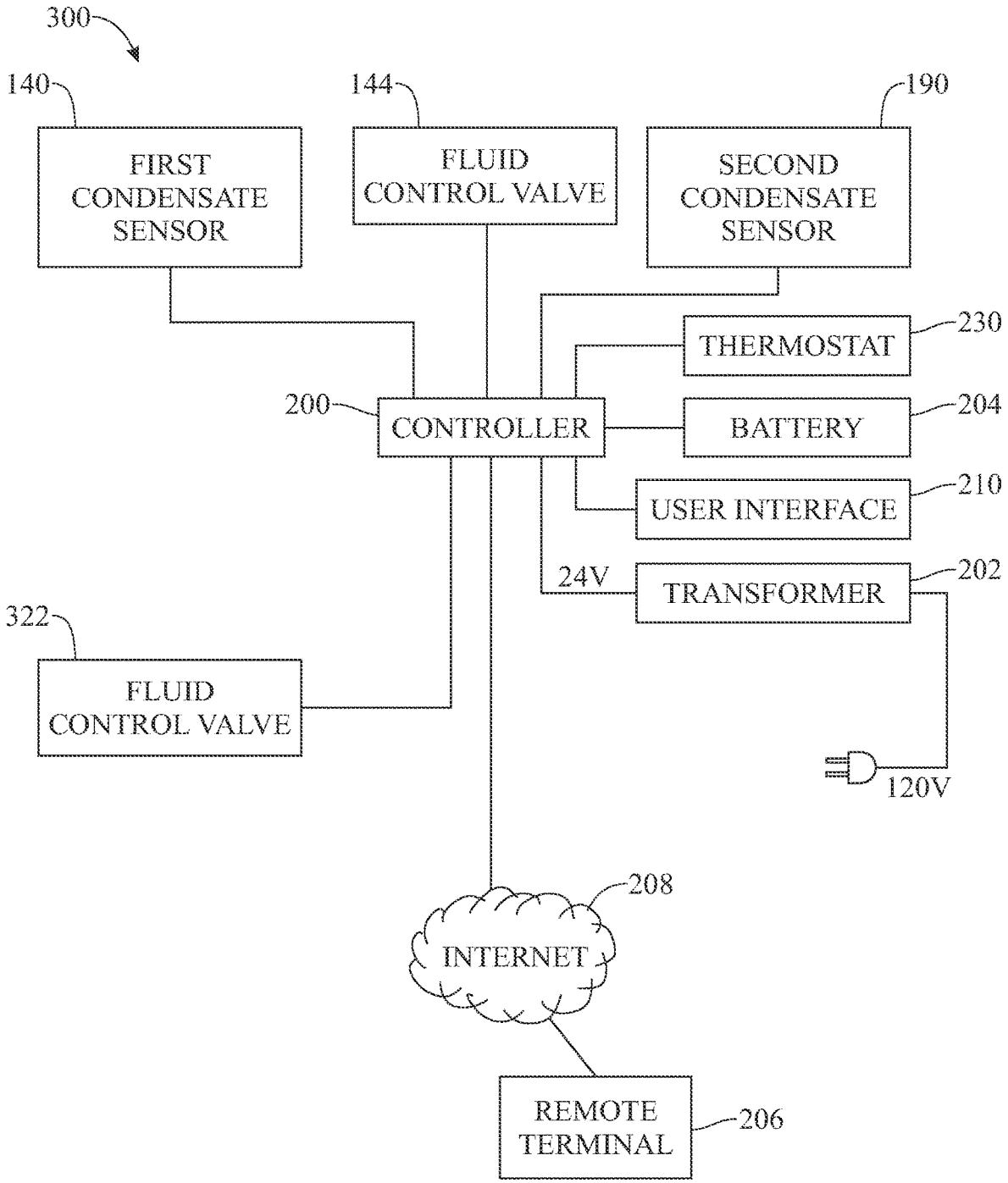
FIG. 6 presents a block diagram of the air conditioning system of FIG. 3.

The illustrations of FIGS. 3-6 show an air conditioning system 300 in accordance with an alternative embodiment of the present invention. With reference initially to FIG. 3, similarly to the previous embodiment, an auxiliary tubing 310 is connected to the tubing fitting 150. The auxiliary tubing 310 of the present embodiment, however, is instead provided with a back flow valve 320, a fluid control valve 322, and a tablet holder 324. The back flow valve 320 is configured to permit a downstream fluid flow towards the tubing fitting 150, as indicated by arrow B, and to block an upstream fluid flow, in a direction opposite to arrow B. The fluid control valve 322 is configured for selectively opening and closing fluid flow through the auxiliary tubing 310, for purposes that will be hereinafter described. The fluid control valve 322 may be normally closed, and may include, for instance and without limitation, a normally-closed solenoid valve or other electrically-operated valve; in a non-limiting example, the solenoid or otherwise electrically-operated, fluid control valve 322 may operate at 24 V. As best shown in FIG. 6, in some embodiments, similarly to the fluid control valves of the previous embodiment, the fluid control valve 322 may be powered by the battery 204 and/or the external power source via the transformer 202. As also shown in FIG. 6, the fluid control valve 322 may be operatively connected to the controller 200, either wirelessly or by a wired connection such that the controller 200 may operate the fluid control valve 322.

Upstream of the back flow valve 320, the auxiliary tubing 310 may be connected to a water line such as, but not limited to, an existing hot water line of the home or business facility configured to supply pressurized hot water. In this way, water from the water line may be fed into the air conditioning system 300 during the cleaning cycle for cleaning the clogged condensate drain tube 142. Therefore, unlike the cleaning cycles of the previous embodiment, in which the cleaning fluid(s) were supplied from containers, the cleaning fluid used by the present embodiment is supplied by a water line.

The tablet holder 324 is configured to contain one or more disinfecting tablets 326 (FIG. 5), and to position at least one of the disinfecting tablets 326 in direct communication with the water flowing through the auxiliary tubing 310. In a non-limiting example, the one of more disinfecting tablets 326 may include at least one commercially available air conditioner condensate drain pan tablet made, for instance, of Benzyl-C12-18-Alkyldimethyl, Ammonium Chloride, and Urea.

The illustrations of FIGS. 4 and 5 show details of the tablet holder 324 in accordance with an illustrative embodiment of the invention. As shown, the tablet holder 324 may include a first housing 330 defining an interior space 332. The first housing 330 may be provided with a movable cover 334 which may be opened and closed to allow or prevent access to the interior space 332, respectively. The one or more disinfecting tablets 326 may be positioned within the interior space 332 of the first housing 330, to contact fluid flowing through the interior space 332. In some embodiments, the one or more disinfecting tablets 326 may be more specifically arranged within an interior space 342 of a second housing 340, which in turn is arranged within the interior space 332 of the first housing 330. The auxiliary tubing 310 may extend through the first housing 330 and second housing 340, as shown in the figures, and further progress towards the tubing fitting 150.

In preferred embodiments, the tablet holder 324 is configured to fluid-tightly house one or more disinfecting tabs 326 within the second housing 340. As further shown, a portion of the auxiliary tubing 310 which extends through the second housing 340 may include an access opening 346, through which the one or more disinfecting tabs 326 may be inserted into the auxiliary tubing 310. The second housing 340 may be provided with a movable cover 344 which may be opened and closed to allow or prevent access to the interior space 342 of the second housing 340, respectively. The movable cover 344 in the closed position may fluid-tightly enclose the interior space 342. In turn, the auxiliary tubing 310 may fluid-tightly interface with the first and second housings 330 and 342. Fluid passing through the tablet holder 324 via the auxiliary tubing 310 may be confined within the auxiliary tubing 310 and the interior space 342 of the fluid-tightly closed second housing 340 for purposes that will be described hereinafter.

In some embodiments, the interior space 332 of the first housing 330 which remains outside the second housing 340, free of fluid (as the fluid is confined within the auxiliary tubing 310 and the interior space 342), may be shaped and sized to store at least one spare disinfecting tablet 326 for subsequent use once the one or more disinfecting tablets 326 arranged within the auxiliary tubing 310 have been dissolved. For instance, in the present embodiment, the second housing 340 of the present embodiment is specifically shaped and sized to house a single disinfecting tablet 326 within the interior space 342, while the first housing 330 is shaped and sized to store at least two similarly shaped and sized disinfecting tablets (see, for instance, spare disinfecting tablets 326' and 326" shown in FIG. 5). When the disinfecting tablet 326 arranged in contact with fluid has dissolved, a user or operator may insert a new disinfecting tablet 326 (or 326' or 326") into the auxiliary tubing 310 via the access opening 346. In embodiments in which one or more spare disinfecting tabs (e.g., disinfecting tabs 326', 326") are stored and readily available within the first housing 330 itself, the tasks of maintaining the auxiliary tubing 310 supplied with a working disinfecting tab 326 and monitoring the amount of spare disinfecting tabs 236', 236" left may be carried out efficiently.

In operation, and with reference initially to FIG. 3, the air conditioning system 300 may detect a clogging of the condensate drain tube 142 and automatically carry out a cleaning cycle, similarly to the air conditioning system 100 of the previous embodiment. Specifically, as in the previous embodiment, the air conditioning system 300 may be in a normally-operating or initial situation in which the first and second condensate sensors 140 and 190 are deactivated, the fluid control valves 144 and 322 are open and closed, respectively, and condensate is draining normally from the primary drain pan 136 of the air handler 110 through the condensate drain tube 142. During this initial situation, the controller 200 may monitor the first and second sensors 140 and 190. At a certain point, the controller 200 may detect the activation of the first condensate sensor 140. At this point, the controller 200 may continue to monitor the second condensate sensor 190. If the controller 200 senses that the second condensate sensor 190 becomes activated within a predetermined time from the activation of the first condensate sensor 140, the controller 200 determines the condensate drain tube 142 is clogged, and responsively sends a command signal to the fluid control valve 144 to close the fluid control valve 144 and thereby cut off fluid communication between the primary drain pan 136 and the condensate drain tube 142. Once the fluid control valve 144 is closed, the controller 200 may then initiate a cleaning cycle.

In order to perform the cleaning cycle, after closing the fluid control valve 144 to prevent backflow, the controller 200 may operate the initially closed, fluid control valve 322 to open the fluid control valve 322. Opening of the fluid control valve 322 allows pressurized water from the water line (arrow B), to which the auxiliary tubing 310 is connected, to pass through the fluid control valve 322 and further through the tablet holder 324. As the water passes through the tablet holder 324, the at least one disinfecting tablet 326 arranged in the way of the flow, such as within the second housing 340 as described heretofore, gradually dissolves into the water, resulting in a cleaning solution. The pressurized, cleaning solution flows down the auxiliary tubing 310 towards the tubing fitting 150 and further into the condensate drain tube 142, breaking and carrying the clog downstream through the condensate drain tube 142 (arrow A). During this cleaning cycle, the closed fluid control valve 144 and the back flow valve 320 prevent flow of the resulting cleaning solution into the air handler 110 and back into the water line, respectively.

After a predetermined amount of time, such as, but not limited to, about 30 to 60 seconds, the controller 200 may end the cleaning cycle by switching the fluid control valve 322 to a closed position. Next, the controller 200 may switch the fluid control valve 144 to an open position to resume condensate draining from the air handler 110 through the condensate drain tube 142. In some embodiments, the controller 200 may wait a predetermined amount of time (e.g., 5-10 seconds) between closing the fluid control valve 322 and opening the fluid control valve 144, to allow for the cleaning solution to further drain through the condensate drain tube 142 before opening the fluid control valve 144. Once the cleaning cycle is finished, operation of the air conditioning system 100 may be restarted by the controller 200 or other applicable control system (e.g., a separate thermostat).

In detecting the clogged condensate drain and responsively operating associated valves to carry out one or more cleaning cycles as described hereinabove, the air conditioning system 100, 300 of the present disclosure is capable of automatically resolving the clogged drain problem without requiring human intervention. In this way, the invention eliminates the need for the home or business owner or occupant to contact an air conditioning servicing company in the event of a clogging or condensate overflow occurrence, and to wait for the company to service the unit, which often leads to increased stress. Furthermore, in many cases, the air conditioning system 100, 300 will self-unclog without the home or business owner or occupant even becoming aware of the condensate drain clogging, eliminating any stress on the part of the home or business owner or occupant. In fact, the air conditioning system 100, 300 may successfully resolve the clogging event before condensate overflows the secondary drain pan 192, thereby preventing damages to surrounding flooring, furniture, or other property.

In some embodiments, the air conditioning system 100, 300 may be configured to carry out maintenance cleaning cycles, such as periodically. The maintenance cleaning cycle settings may be adjusted, for instance and without limitation, via the user interface 210, remotely, and/or during installation or manufacture of the controller 200. The maintenance cleaning cycles may be essentially the same as the cleaning cycles described heretofore, except that the maintenance cleaning cycle may be triggered by the controller 200 instead of by the activation of the first and second condensate sensors 140 and 190 as described heretofore. Prior to starting the maintenance cleaning cycle, the controller 200 may switch off the air conditioning system 100, 300. Once the maintenance cleaning cycle has been completed, the controller 200 may switch on the air conditioning system 100, 300.

In some embodiments, at the start, during, and/or at the end of the clogging event cleaning cycle or maintenance cleaning cycle, the controller 200 may send information relative to the cleaning cycle to an external electronic device, via the communications module as described heretofore, such as for billing, informational, statistical, and/or other purposes.

As described heretofore with reference to the embodiments of FIGS. 1-2 and 3-6, the clogging event cleaning cycle may be carried out when, from an initial situation in which the air conditioning system 100, 300 is operating normally, with the first and second condensate sensors 140 and 190 deactivated, the controller 200 detects the activation of the first condensate sensor 140 followed by an activation of the second condensate sensor 190 within a predetermined time. In some embodiments, the controller 200 may be further configured to sense alternative conditions starting from this initial situation and responsively carry out corresponding actions, which may be different to the cleaning cycles described heretofore.

For example, in one embodiment, from the initial situation, the controller 200 may detect the activation of the first condensate sensor 140, but may not detect an activation of the second condensate sensor 190 within the predetermined time. The controller 200 may responsively deactivate the air conditioning system 100, 300, or, alternatively, the air conditioning system 100, 300 may be deactivated by another device (e.g., an existing float switch) as described heretofore. Furthermore, the controller 200 may determine that the air conditioning system 100, 300 is potentially malfunctioning in such a way that human intervention is required, and may responsively send information to a remote electronic device, via the communications module as described heretofore, informative of the malfunction. For example, the controller 200 may send information to a remote server via the computer network 208, containing data identifying the controller 200 and event. The remote server may responsively instruct a technician to service the air conditioning system 100, 300. In some embodiments, the home or business occupant or owner, or other user, via an associated electronic device (e.g., a smartphone) may be informed by the server (e.g., via email or text message) of such instruction to service the air conditioning system 100, 300 being sent to a technician; alternatively or additionally, the server may acknowledge said instruction to service to the controller 200, which in turn may inform the nearby users of said instruction via the user interface 210, for instance and without limitation. Thus, the air conditioning system 100, 300 may automatically set up a technician visit responsively to detecting the potential malfunction.

In another example, from the initial situation, the controller 200 may detect the activation of the second condensate sensor 190 without an activation of the first condensate sensor 140. Responsively, the controller 200 may determine there is another potential malfunction of the air conditioning system 100, 300, and may switch off the air conditioning system 100, 300. Furthermore, the controller 200 may send information to a remote electronic device, via the communications module as described heretofore, and further proceed with similar steps as those described with reference to the previous example.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An air conditioning system, comprising:

a primary fluid control valve, operable to selectively allow or prevent fluid flow between an air handler of an air conditioning system and a condensate drain tube of the air conditioning system, the condensate drain tube configured to drain condensate from the air handler;

one or more secondary fluid control valves, wherein each secondary fluid control valve is arranged between a respective fluid source and a respective point of connection to the condensate drain tube downstream of the primary fluid control valve and is operable to selectively allow or prevent fluid flow from the respective fluid source into the condensate drain tube;

a first condensate sensor configured to sense condensate in a first area;

a second condensate sensor configured to sense condensate in a second area arranged vertically lower than the first area; and a controller, operatively connectable to the primary fluid valve, the one or more secondary fluid control valves, the first condensate sensor and the second condensate sensor, the controller comprising a processor and a memory, the memory storing processor-readable instructions configured to cause the processor to execute the operations of:

allowing the air conditioning system to operate in a normally-operating condition, in which the primary fluid control valve allows fluid flow from the air handler through the condensate drain tube, and in which each secondary fluid control valve of the one or more secondary fluid control valves prevents fluid flow from its respective fluid source into the condensate drain tube, with the air conditioning system in the normally-operating condition, detecting an activation of the first condensate sensor, detecting an activation of the second condensate sensor within a predetermined time from the activation of the first condensate sensor, and responsively to detecting an activation of the second condensate sensor within said predetermined time from the activation of the first condensate sensor, cleaning the condensate drain tube by operating the primary fluid control valve to prevent fluid flow from the air handler through the condensate drain tube and by operating at least one secondary fluid control valve of the one or more secondary fluid control valves to allow fluid flow from the respective fluid source of said at least one secondary fluid control valve into the condensate drain tube while the primary fluid control valve prevents fluid flow from the air handler through the condensate drain tube.

2. The air conditioning system of claim 1, wherein the one or more secondary fluid control valves comprise a compressed air control valve and the respective fluid source of the compressed air control valve comprises a compressed air source, and further wherein said operating of said at least one secondary fluid control valve comprises operating the compressed air control valve to allow compressed air to flow from the compressed air source into the condensate drain tube.

3. The air conditioning system of claim 2, wherein the compressed air source comprises a compressed air container.

4. The air conditioning system of claim 2, wherein operating the compressed air control valve comprises operating the compressed air control valve intermittently to allow bursts of said compressed air to flow from the compressed air source into the condensate drain tube.

5. The air conditioning system of claim 1, wherein the one or more secondary fluid control valves comprise a liquid control valve and the respective fluid source of the liquid control valve comprises a liquid source, and further wherein said operating of said at least one secondary fluid control valve comprises operating the liquid control valve to allow a liquid to flow from the liquid source into the condensate drain tube.

6. The air conditioning system of claim 5, wherein the liquid source comprises a liquid container.

7. The air conditioning system of claim 6, wherein the liquid comprises a cleaning solution contained by the liquid container.

8. The air conditioning system of claim 5, wherein the liquid source comprises a pressurized water line.

9. The air conditioning system of claim 8, wherein the pressurized water line comprises a pressurized hot water line.

10. The air conditioning system of claim 5, wherein the one or more secondary fluid control valves further comprise a compressed air control valve and the respective fluid source of the compressed air control valve comprises a compressed air source, and further wherein said operating of said at least one secondary fluid control valve comprises operating the compressed air control valve to allow compressed air to flow from the compressed air source into the condensate drain tube.

11. The air conditioning system of claim 10, wherein the point of connection of the liquid control valve is the same as the point of connection of the compressed air control valve.

12. The air conditioning system of claim 10, wherein said operating of said at least one secondary fluid control valve comprises:

operating the compressed air control valve to prevent fluid communication between the compressed air source and the condensate drain tube during operation of the liquid control valve to allow a liquid to flow from the liquid source into the condensate drain tube, and operating the liquid control valve to prevent fluid communication between the liquid source and the condensate drain tube during operation of the compressed air control valve to allow compressed air to flow from the compressed air source into the condensate drain tube.

13. The air conditioning system of claim 10, wherein said operating of said at least one secondary fluid control valve comprises alternately operating the liquid control valve and the compressed air control valve to alternately allow said liquid to flow from the liquid source into the condensate drain tube and said compressed air to flow from the compressed air source into the condensate drain tube.

14. The air conditioning system of claim 1, wherein the one or more secondary fluid control valves consist of a liquid control valve and the respective fluid source of the liquid control valve consists of a pressurized water line, and further wherein said operating of said at least one secondary fluid control valve comprises operating the liquid control valve to allow pressurized water to flow from the liquid source into the condensate drain tube.

15. The air conditioning system of claim 1, further comprising a communications module operatively connected to the controller, the communications module configured to communicate with an external electronic device, and further wherein the memory stores processor-readable instructions configured to cause the processor to further execute the operations of:

detecting that the second condensate sensor has not activated within said predetermined time from the activation of the first condensate sensor, and responsively transmitting a signal to the external electronic device via the communications module, the signal indicative of an anomaly associated with the air conditioning system.

16. The air conditioning system of claim 1, further comprising a communications module operatively connected to the controller, the communications module configured to communicate with an external electronic device, and further wherein the memory stores processor-readable instructions configured to cause the processor to further execute the operations of:

with the air conditioning system in the normally-operating condition, detecting an activation of the second condensate sensor in the absence of an activation of the first condensate sensor, and responsively transmitting a signal to the external electronic device via the communications module, the signal indicative of an anomaly associated with the air conditioning system.

17. The air conditioning system of claim 1, wherein the second area is located within a secondary drain pan arranged below and vertically spaced-apart from the air handler.

18. The air conditioning system of claim 17, wherein the first area is located within a primary drain pan of the air handler above and vertically spaced-apart from the secondary drain pan.

19. An air conditioning system, comprising:

a primary fluid control valve, operable to selectively allow or prevent fluid flow between an air handler of an air conditioning system and a condensate drain tube of the air conditioning system, the condensate drain tube configured to drain condensate from the air handler;

one or more secondary fluid control valves, wherein each secondary fluid control valve is arranged between a respective fluid source and a respective point of connection to the condensate drain tube downstream of the primary fluid control valve and is operable to selectively allow or prevent fluid flow from the respective fluid source into the condensate drain tube;

a first condensate sensor configured to sense condensate in a first area located within a primary drain pan of the air handler;

a second condensate sensor configured to sense condensate in a second area located within a secondary drain pan arranged below and vertically spaced-apart from the primary drain pan of the air handler, the second area arranged vertically lower than the first area;

a controller, operatively connectable to the primary fluid valve, the one or more secondary fluid control valves, the first condensate sensor and the second condensate sensor, the controller comprising a processor and a memory; and a communications module operatively connected to the controller and configured to communicate with an external electronic device; wherein the memory stores processor-readable instructions configured to cause the processor to execute the operations of:

allowing the air conditioning system to operate in a normally-operating condition, in which the primary fluid control valve allows fluid flow from the air handler through the condensate drain tube, and in which each secondary fluid control valve of the one or more secondary fluid control valves prevents fluid flow from its respective fluid source into the condensate drain tube, with the air conditioning system in the normally-operating condition, detecting an activation of the first condensate sensor, detecting an activation of the second condensate sensor within a predetermined time from the activation of the first condensate sensor, responsively to detecting an activation of the second condensate sensor within said predetermined time from the activation of the first condensate sensor, cleaning the condensate drain tube by operating the primary fluid control valve to prevent fluid flow from the air handler through the condensate drain tube and by operating at least one secondary fluid control valve of the one or more secondary fluid control valves to allow fluid flow from the respective fluid source of said at least one secondary fluid control valve into the condensate drain tube while the primary fluid control valve prevents fluid flow from the air handler through the condensate drain tube, detecting that the second condensate sensor has not activated within said predetermined time from the activation of the first condensate sensor, and responsively to detecting that the second condensate sensor has not activated within said predetermined time from the activation of the first condensate sensor, transmitting a signal to the external electronic device via the communications module, the signal indicative of an anomaly associated with the air conditioning system.

20. An air conditioning system, comprising:

a primary fluid control valve, operable to selectively allow or prevent fluid flow between an air handler of an air conditioning system and a condensate drain tube of the air conditioning system, the condensate drain tube configured to drain condensate from the air handler;

one or more secondary fluid control valves, wherein each secondary fluid control valve is arranged between a respective fluid source and a respective point of connection to the condensate drain tube downstream of the primary fluid control valve and is operable to selectively allow or prevent fluid flow from the respective fluid source into the condensate drain tube;

a first condensate sensor configured to sense condensate in a first area located within a primary drain pan of the air handler;

a second condensate sensor configured to sense condensate in a second area located within a secondary drain pan arranged below and vertically spaced-apart from the primary drain pan of the air handler, the second area arranged vertically lower than the first area;

a controller, operatively connectable to the primary fluid valve, the one or more secondary fluid control valves, the first condensate sensor and the second condensate sensor, the controller comprising a processor and a memory; and a communications module operatively connected to the controller and configured to communicate with an external electronic device; wherein the memory stores processor-readable instructions configured to cause the processor to execute the operations of:

allowing the air conditioning system to operate in a normally-operating condition, in which the primary fluid control valve allows fluid flow from the air handler through the condensate drain tube, and in which each secondary fluid control valve of the one or more secondary fluid control valves prevents fluid flow from its respective fluid source into the condensate drain tube, with the air conditioning system in the normally-operating condition, detecting an activation of the first condensate sensor, detecting an activation of the second condensate sensor within a predetermined time from the activation of the first condensate sensor, responsively to detecting an activation of the second condensate sensor within said predetermined time from the activation of the first condensate sensor, cleaning the condensate drain tube by operating the primary fluid control valve to prevent fluid flow from the air handler through the condensate drain tube and by operating at least one secondary fluid control valve of the one or more secondary fluid control valves to allow fluid flow from the respective fluid source of said at least one secondary fluid control valve into the condensate drain tube while the primary fluid control valve prevents fluid flow from the air handler through the condensate drain tube, detecting that the second condensate sensor has not activated within said predetermined time from the activation of the first condensate sensor, responsively to said detecting that the second condensate sensor has not activated within said predetermined time from the activation of the first condensate sensor, transmitting a signal to the external electronic device via the communications module, the signal indicative of an anomaly associated with the air conditioning system, with the air conditioning system in the normally-operating condition, detecting an activation of the second condensate sensor in the absence of an activation of the first condensate sensor, and responsively to said detecting of an activation of the second condensate sensor in the absence of an activation of the first condensate sensor, transmitting a signal to the external electronic device via the communications module, the signal indicative of an anomaly associated with the air conditioning system.

* * * * *